US005830028A

United States Patent [19]

Zovko et al.

[11] Patent Number: 5,830,028

[45] Date of Patent: Nov. 3, 1998

[54] ROLL COATED EL PANEL

[75] Inventors: Charles I. Zovko, Chandler; Rodney T. Eckersley, Tempe, both of Ariz.

[73] Assignee: Durel Corporation, Chandler, Ariz.

[21] Appl. No.: 867,637

[22] Filed: Jun. 2, 1997

Related U.S. Application Data

[62] Division of Ser. No. 585,662, Jan. 16, 1996.

[51] Int. Cl.[6] ..... H05B 33/02

[52] U.S. Cl. ..... 445/24; 445/52

[58] Field of Search ..... 445/24, 52; 313/503, 313/504, 509, 511

[56] References Cited

U.S. PATENT DOCUMENTS 4,684,353 8/1987 DeSouza ..... 445/51

5,055,360 10/1991 Ogura et al. ..... 313/509 X 5,309,060 5/1994 Sharpless et al. ..... 313/511

5,399,936 3/1995 Namiki et al. ..... 313/504

5,488,266 1/1996 Aoki et al. ..... 313/509

*Primary Examiner*—Kenneth J. Ramsey

*Attorney, Agent, or Firm*—Paul F. Wille; Fennemore Craig

[57] ABSTRACT

In a process for making an EL lamp, a rear electrode is roll coated on a temporary substrate, followed by successive roll coatings of a dielectric layer and a phosphor layer. A transparent, conductive layer on a transparent substrate is laminated to the phosphor layer layer and the temporary substrate is removed. The layers are applied from a slurry or ink and bladed to a uniform thickness across the width of the temporary substrate. The process can be continuous using rolls of material for the temporary substrate. The length of a lamp is limited by the length of the temporary substrate. The width of the lamp is determined by the size of the apparatus used to apply and to spread the layers.

10 Claims, 4 Drawing Sheets

ROLL COATED EL PANEL

CROSS-REFERENCE TO RELATED APPLICATION

This application is a division of Ser. No. 585,662, filed Jan. 16, 1996, now .

BACKGROUND

This invention relates to electroluminescent (EL) lamps and, in particular, to a low cost process for making an EL panel having a large area. As used herein, an EL "panel" is a single substrate including one or more luminous areas, wherein each luminous area is an EL "lamp."

An EL lamp is essentially a capacitor having a dielectric layer between two conductive electrodes, one of which is transparent. The dielectric layer can include a phosphor powder or there can be a separate layer of phosphor powder adjacent the dielectric layer. As used herein, "luminescent EL layer" is generic to a dielectric layer containing phosphor and to separate layers. The phosphor powder radiates light in the presence of a strong electric field, using very little current.

A modern (post-1980) EL lamp typically includes transparent substrate of polyester or polycarbonate material having a thickness of about 7.0 mils (0.178 mm.). A transparent, front electrode of indium tin oxide or indium oxide is vacuum deposited onto the substrate to a thickness of 1000 A° or so. A phosphor layer is screen printed over the front electrode and a dielectric layer is screen printed over phosphor layer. A rear electrode is screen printed over the dielectric layer.

The inks used for screen printing include a binder, a solvent, and a filler, wherein the filler determines the nature of the printed layer. A typical solvent is dimethylacetimide (DMAC) or ethylbutylacetate (EB acetate). The binder is typically a fluoropolymer such as polyvinylidene fluoride/hexafluoropropylene (PVDF/HFP), polyester, vinyl, or epoxy. A phosphor layer is typically screen printed from a slurry containing a solvent, a binder, and zinc sulphide particles. A dielectric layer is typically screen printed from a slurry containing a solvent, a binder, and barium titanate ($BaTiO_3$) particles. A rear (opaque) electrode is typically screen printed from a slurry containing a solvent, a binder, and conductive particles such as silver or carbon. Since the solvent and binder for each layer are chemically the same or similar, there is chemical compatibility and good adhesion between adjoining layers.

The respective layers must be in register and the screen printing process limits a panel to maximum dimensions of about 18"×24". Screen printed layers in large area panels tend to have problems with uniformity of thickness. EL lamps, of any size, having a screen printed layer exhibit a characteristic graininess when lit that is undesirable for small, closely viewed lamps, such as in watch faces. For many applications, the precision available from screen printing is not necessary and a panel having a dimensions larger than 18"×24" is desired.

Even though screen printing is a well developed technology and, therefore, relatively low in cost, an even less expensive process for making EL lamps is desired. Further, there are disadvantages to screen printing. The resolution of screen printing is not as good as desired. For example, printing a fine line gap, e.g. 0.001" wide, between conductors cannot be done reliably by screen printing adjacent conductors. Screen printing requires much handling of the substrate on which the layers are being printed, resulting in scratches in the outer surface of the substrate. In EL lamps, the outer surface of the substrate is the front of the lamp and scratches are highly undesirable.

It is known in the art to use a temporary substrate for making an EL lamp and to peel or otherwise remove the layers of the lamp from the temporary substrate. For example, U.S. Pat. No. 3,341,915 (Knochel et al.) discloses depositing a transparent, conductive layer of copper iodide on a polyacrylate substrate, depositing a phosphor dielectric layer on the copper iodide, and then depositing an aluminum rear electrode. The front electrode does not adhere well to the substrate and the lamp is peeled off the substrate.

It is also known in the art to laminate an EL lamp. U.S. Pat. No. 4,560,902 (Kardon) discloses depositing a dielectric film on a sheet of aluminum foil, depositing a phosphor layer on a Mylar® sheet coated with indium tin oxide, and then laminating the two sheets together at 150 psi and 150° C.

U.S. Pat. No. 4,684,353 (deSouza) discloses a support film having a base film attached by a heat-sensitive, releasable adhesive. A phosphor layer is screen printed on the base film and, after curing, the phosphor layer and base film are removed from the support film and electrodes are applied to the opposed major surfaces of the phosphor layer.

U.S. Pat. No. 5,469,109 (Mori) discloses laminating two coated, transparent sheets together wherein a first sheet includes a transparent electrode, a phosphor layer, and a dielectric layer and a second sheet includes an adhesive layer and a rear electrode overlying the adhesive layer. The adhesive layer is larger than the rear electrode and contacts the first sheet, enclosing the phosphor layer and the dielectric layer to seal the lamp.

In view of the foregoing, it is therefore an object of the invention to provide a process for making EL lamps at low cost.

Another object of the invention is to provide a process for making EL lamps having a large area.

A further object of the invention is to provide a process for making EL lamps in which the lamps are less grainy than lamps having one or more screen printed layers.

Another object of the invention is to provide an improved process for making EL lamps using existing materials.

A further object of the invention is to provide EL lamps with fine line geometries.

Another object of the invention is to provide a process for making EL lamps in which scratches are minimized.

SUMMARY OF THE INVENTION

The foregoing objects are achieved by the invention in which a rear electrode is applied to a temporary substrate, at least partially dried or cured, and then coated with a dielectric layer and a phosphor layer. A transparent, front electrode on a transparent substrate is laminated to the phosphor layer. The layers are applied from a slurry or ink and bladed to a uniform thickness across the width of the temporary substrate. The process can be continuous using rolls of material for the temporary substrate. The length of a lamp is limited by the length of the temporary substrate. The width of the lamp is determined by the size of the blades used to spread the layers. It has been discovered that the invented process produces an EL lamp having a less grainy appearance than EL lamps having a screen printed layer.

In accordance with another aspect of the invention, a temporary substrate is coated with a dielectric layer and a phosphor layer and then laminated to a transparent, front electrode on a transparent substrate. The temporary substrate is removed and a rear electrode is laminated to the dielectric layer. The rear electrode is preferably roll coated on a temporary substrate prior to lamination.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
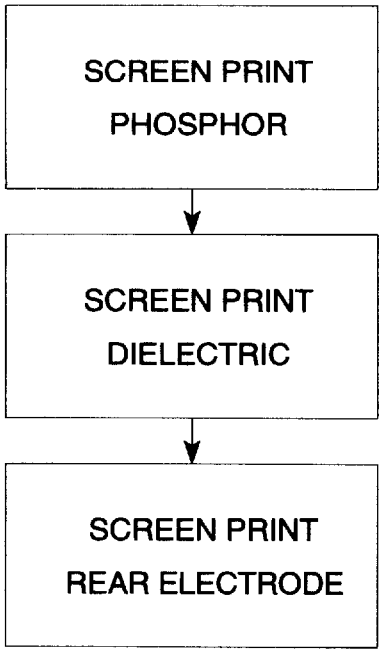
FIG. 1 (PRIOR ART)
FIG. 1 is a flow chart for making an EL lamp in accordance with the prior art.

FIG. 1 is a flow chart for making an EL panel in accordance with the prior art. Transparent substrates coated with a transparent conductive film are commercially available. In the prior art, a lamp is made by screen printing a suitable EL phosphor on the conductive film, screen printing a dielectric layer over the phosphor layer, and then screen printing a rear electrode over the dielectric layer. Throughout the process, the transparent substrate is the base upon which the lamp is built.

Figure 2:
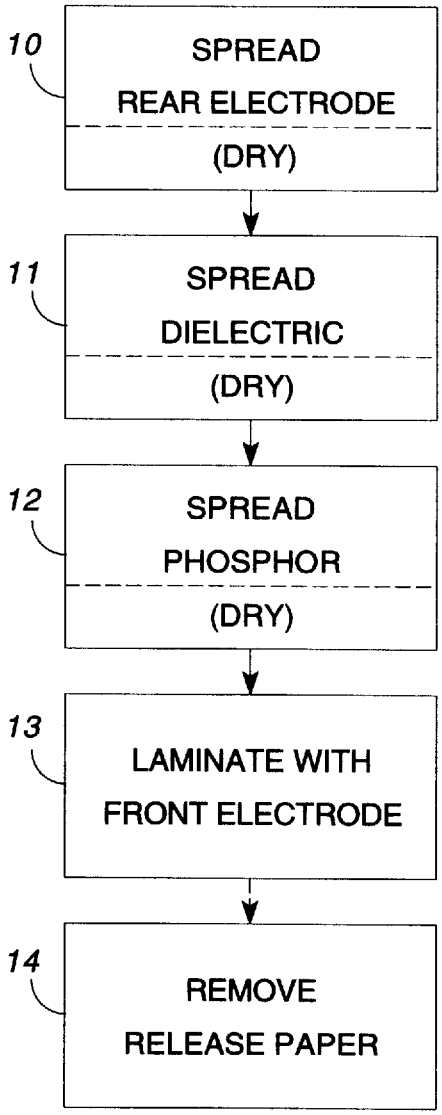
FIG. 2 is a flow chart for making an EL lamp in accordance with a preferred embodiment of the invention.

In accordance with the invention, as illustrated in FIG. 2, a phosphor layer, a dielectric layer, and a rear electrode are applied to a temporary substrate in the opposite order from the flow chart of FIG. 1. The temporary substrate is laminated to a transparent substrate and then the temporary substrate is peeled away from the rear electrode. Suitable inks for the respective layers are essentially poured or cast onto the temporary substrate and then spread to a uniform thickness. The result is a lamp that is noticably less grainy than a lamp made by screen printing and is less expensive to make than a screen printed lamp.

Figure 3:
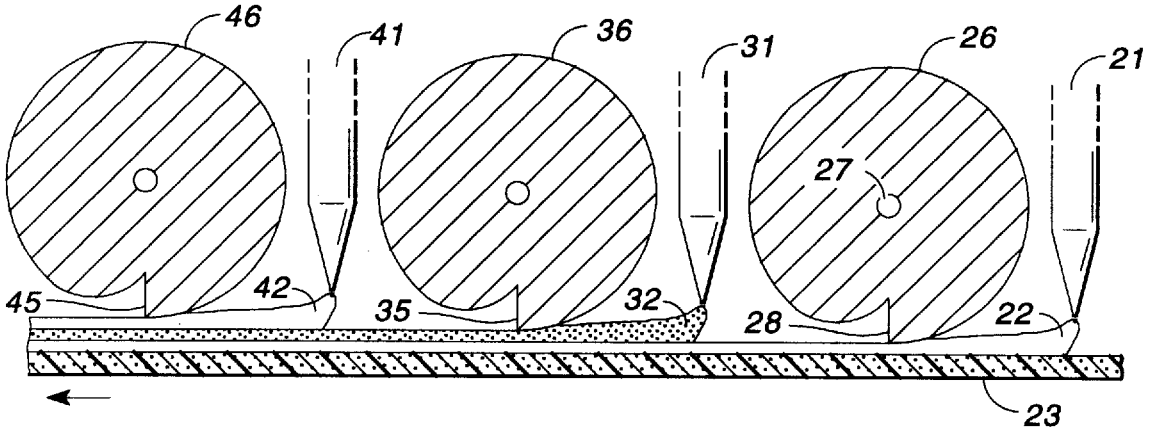
FIG. 3 illustrates sequentially roll coating layers on a temporary substrate.

For step 10, a conductive ink is applied to a temporary substrate and spread to a uniform thickness by a doctor blade or a roll coating apparatus. The substrate is a release paper or plastic to which the ink will not adhere, such as silicone treated polyester or paper. FIG. 3 illustrates a preferred apparatus for making an EL panel in accordance with the invention. A plurality of injectors, such as injector 21, are spaced across the width of temporary substrate 23 and apply a measured quantity of ink 22 to the substrate. Substrate 23 moves to the left, as the apparatus is oriented in FIG. 3.

Roll 26 is mounted on axle 27 and is positioned with the outer surface thereof a fixed, predetermined distance above the upper surface of temporary substrate 23, e.g. 0.0001"–0.0100". Roll 26 includes an abrupt change in radius at the tangent point with ink layer 22. The abrupt change in radius preferably includes an edge extending radially toward axle 27. Edge 28 prevents ink 22 from adhering to roll 26 and from being lifted by roll 26 at a point past the tangent point. Other details of roll coating are known to those of skill in the coating art. FIG. 3 illustrates on example of what is generically referred to as roll coating apparatus, specifically a blade over a flat plate. Roll coating apparatus includes a blade over a roller, gravure, flexography, air knife, and reverse rolls, among others.

If substrate 23 is obtained from a coiled sheet of material, the process illustrated in FIG. 3 is essentially continuous and lamps of any desired length can be made. Unlike lamps made with screen printing apparatus, the length of a roll coated lamp can be much greater than the 24" typically available. In FIG. 3, the width of a lamp is determined by the dimension of roll 26 perpendicular to the plane of the drawing. Such rolls are commercially available in widths of 6" to 72" and lengths in excess of one hundred yards.

Although roll coating essentially removes any limit on the size of an EL lamp, a more important advantage of roll coating is that the thickness of the applied layers is much more uniform across the length and width of a lamp than obtainable by screen printing. Another advantage is that the roll coating increases the rate at which EL lamps can be produced. A further advantage is that the layers are formed on a temporary substrate, i.e. the transparent substrate is handled only once, for the lamination step, thereby reducing scratches on the transparent substrate.

The rear electrode dries at a rate determined by the boiling point of the solvent, the temperature of the ink, and air circulation. The ink is dried (cured) in an oven (not shown) in line with the roll coater. After the rear electrode is at least partially dry, the temporary substrate is coated with a dielectric layer.

For step 11 (FIG. 2), a plurality of injectors, such as injector 31, apply a measured quantity of dielectric ink 32 that is then spread and reduced in thickness by edge 35 on roll 36. Dielectric ink 32 is then at least partially dried. For step 12 (FIG. 2), a plurality of injectors, such as injector 41, apply a measured amount of phosphor ink 42 which is then spread and reduced in thickness by edge 45 on roll 46. The layers are then dried completely and the temporary substrate is cut into panels of a size appropriate for a particular product.

The apparatus shown in FIG. 3 provides a temporary substrate having a rear electrode, a dielectric layer, and a phosphor layer of substantially uniform thicknesses with the phosphor layer outermost. Production rate is higher than obtainable from screen printing and ink utilization can approach one hundred percent, thereby reducing the cost of the panel. Further, the panel is dimensionally accurate.

The coated substrate is then slit into strips of the desired width. Single lamp elements of desired shape and size can be die cut from the substrate. The strips or lamp elements are then laminated to a transparent front electrode in a hot roll laminator. The phosphor layer adheres to the transparent conductor and a continuous strip of finished lamps comes out of the laminator. Alternatively, the coated substrate is laminated to a transparent substrate prior to cutting into strips or into individual lamp shapes.

Figure 4:
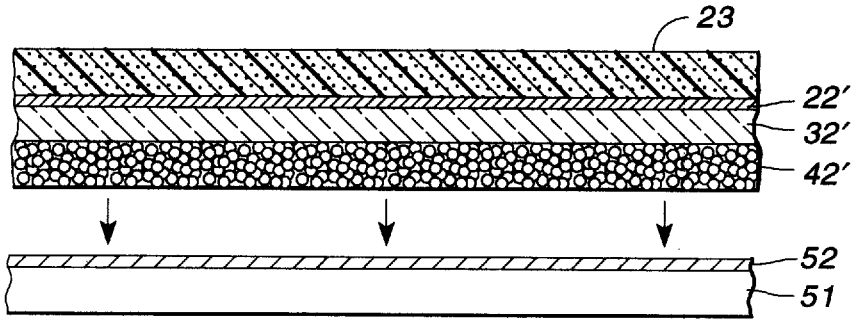
FIG. 4 illustrates laminating the front electrode to the coated layers.

FIG. 4 illustrates step 13 (FIG. 2) in which a coated, temporary substrate is laminated with transparent substrate 51. The difficulty with this step is that the organic binder and filler in the phosphor layer must adhere to inorganic, transparent front electrode 52. In step 14 (FIG. 2), the substrates are squeezed together under a predetermined pressure and heated to a temperature sufficient to cause the binder in the phosphor layer to adhere to the front electrode. In a preferred embodiment of the invention, the front electrode is pretreated with a coupling agent to promote adhesion between the adjoining organic and inorganic layers.

Figure 5:
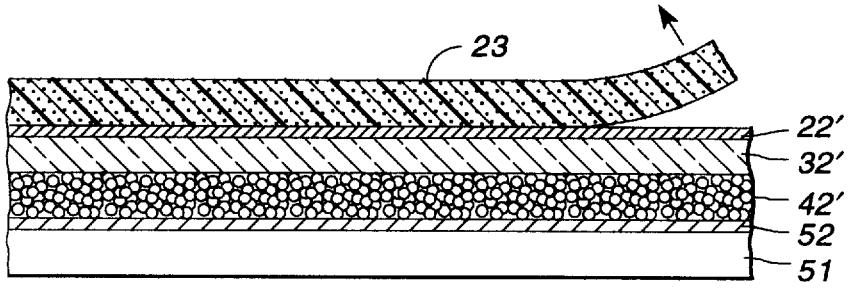
FIG. 5 illustrates removing the temporary substrate from the rear of a lamp panel.

After the phosphor layer is bonded to front electrode 52, the temporary substrate is removed, as illustrated in FIG. 5. The adhesion between temporary substrate 23 and rear electrode 22' is less than the adhesion between rear electrode 22' and dielectric layer 32'. Temporary substrate 23 is removed, leaving a plurality of completed lamps. If the coated, temporary substrate had not been cut or patterned, the lamination is then cut as desired to produce either smaller panels or individual EL lamps. The lamps produced by this process have a characteristically smoother appearance than lamps produced by screen printing.

The process in accordance with the invention utilizes existing materials to make EL lamps less expensively and with less graininess. The invention is further illustrated by the following Examples.

EXAMPLE 1

A. Ink preparation

| Ink Base Formula: | |
|---|---|
| Kynar | 45% |
| DMAC (dimethylacetimide) | 45% |
| EB Acetate | 9% |
| Modaflow | 1% |

The EB Acetate is an "extender", that is, the material prevents the ink from drying too quickly. Modaflow is a flow agent, that is, the material prevents bubbling. These materials are helpful but are not critical.

B. Rear Conductor Ink Formula, Application and Curing

| | |
|---|---|
| Ink Base | 39.28% |
| silver flake | 53.64% |
| DMAC | 6.02% |
| EB Acetate | 1.06% |
| release liner | silicone coated paper |

The ink is roll coated on top of the release liner with 0.002" gap and dried at 250° F. for 10 minutes.

C. Dielectric Ink Formula Application and Curing

| | |
|---|---|
| Ink Base | 55.0% |
| $BaTiO_3$ | 45.0% |

The ink is roll coated on top of the rear conductor (above) with 0.002" gap and dried at 250° F. for 10 minutes.

D. Phosphor Ink Formula Application and Curing

| | |
|---|---|
| Ink Base | 62.87% |
| Phosphor 723—500 mesh | 37.13% |

The ink is roll coated on top of the rear conductor and dielectric layer (above) with 0.002" gap and dried at 250° F. for 10 minutes.

E. Laminating the Cast Lamp to the Front Electrode

The cast lamp is cut to the desired shape to be laminated to the front electrode. The substrate with the front electrode is cut to the desired shape, usually the shape of the final lamp. The front electrode is treated with silane solution. A thin layer of the silane solution is applied to front electrode and dried with hot air to evaporate the solvents and leave a very thin layer of silane on top of the front electrode. The composition of the silane solution is:

| | |
|---|---|
| Methanol | 93.1% |
| De-ionized Water | 4.9% |
| Silane | 2.0% |

Note 1: The surface treatment of the front electrode is not essential to make a lamp but improves the bond between the front electrode and the phosphor layer.

Note 2: The material commonly referred to as "silane" is not $SiH_4$ (a gas) but a siloxane (a liquid), preferably N-(2-aminoethyl)-3-aminopropyltrimethoxysilane.

After the temporary substrate is coated, a panel is laminated together in a nip roll under the following conditions.

| | | |
|---|---|---|
| Temperature: | | Top Roller: 335° F.<br>Bottom Roller: Room Temp. |
| Roller Speed | ≈ | 8 ft/min. |

The substrate with front electrode is fed straight, while the lamp layer on the release liner were wrapped half way around the hot roller and then fed into the nip. The lamp is laminated phosphor layer to front electrode. A hot platen laminator could be used instead to produce cast-laminated lamps.

EXAMPLE 2

A. Ink Preparation

| acryloid solution: | |
|---|---|
| B-44 Acryloid | 40.0% |
| DMAC | 60.0% |

The acryloid solution acts as a hardener. The solution hardens the layers and improves resistance to shorting when cutting or punching lamps from a panel.

B. Rear Conductor Ink Formula, Application and Curing

| | |
|---|---|
| Ink Base (as in Ex. 1) | 33.43% |
| Acryloid Solution | 5.36% |
| Silver Flake | 51.58% |
| DMAC | 7.70% |
| EB Acetate | 1.93% |

The ink is roll coated on top of a release liner with 0.002" gap and dried at 250° F. for 10 minutes.

C. Dielectric Ink Formula Application and Curing

| | |
|---|---|
| Ink Base (as in Example 1) | 45.18% |
| Acryloid B-44 Solution | 7.25% |
| DMAC | 4.72% |
| EB Acetate | 1.05% |
| BaTiO3 | 41.80% |

The ink is roll coated on top of the rear conductor (above) with 0.002" gap and dried at 250° F. for 10 minutes.

D. Phosphor Ink Formula Application and Curing

| | |
|---|---|
| Ink Base (as in Example 1) | 54.68% |
| Acryloid B-44 Solution | 8.78% |
| Phosphor 723—500 mesh | 36.54% |

The ink is roll coated on top of the rear conductor and dielectric layer (above) with 0.002" gap and dried at 250° F. for 10 minutes.

E. Laminating the Cast Lamp to the Front Electrode

| | |
|---|---|
| Temperature: | Top Roller 350° F., Bottom Roller 355° F. |
| Roller Speed | ≈2 ft/min. |
| Pressure | ≈22 psi |

The front electrode was treated with silane solution (per the above formula) prior to laminating. The substrate with the front electrode and the release liner with the lamp layers were both fed straight into the nip. The lamp was laminated phosphor layer to front electrode.

EXAMPLE 3

A. Ink Preparation

| Ink Base Formula: | |
|---|---|
| PVDF/HFP | 34.9% |
| DMAC (dimethylacetimide) | 51.5% |
| EB Acetate | 12.9% |
| Modaflow | 0.7% |

B. Rear Conductor Ink Formula, Application and Curing

| | |
|---|---|
| Ink Base Formulation | 23.4% |
| Synthetic Graphite | 40.9% |
| DMAC | 28.7% |
| EB Acetate | 7.0% |

The ink is roll coated on top of a release liner with 0.002" gap and dried at 250° F. for 10 minutes.

C. Dielectric Ink Formula Application and Curing

| | |
|---|---|
| Ink Base Formulation | 61.4% |
| $BaTiO_3$ | 38.6% |

The ink is roll coated on top of the rear conductor (above) with 0.002" gap and dried at 250° F. for 10 minutes.

D. Phosphor Ink Formula Application and Curing

| | |
|---|---|
| Ink Base Formulation | 65.6% |
| Phosphor | 34.4% |

The ink is roll coated on top of the rear conductor and dielectric layer (above) with 0.002" gap and dried at 250° F. for 10 minutes.

E. Laminating of the Cast Lamp to the Front Electrode

The cast lamp is cut to the desired shape to be laminated to the front electrode as above in example 2.

As described thus far, the rear electrode, the dielectric layer, and the phosphor layer are treated together to produce a large area panel. Smaller lamps or lamps of various shapes can be made by cutting the panel. However, it is preferable not to cut or pattern the dielectric layer or the phosphor layer. Because the phosphor layer is luminous only where the front electrode and the rear electrode overlap, it is only necessary to pattern either or both of the electrodes in order to produce lamps of various shapes and sizes on a single substrate. Thus, a roll coated dielectric layer and a roll coated phosphor layer can be laminated with patterned or plain, i.e. non-patterned, electrodes in four combinations, in which the rear electrode may or may not be made by roll coating a temporary substrate.

| Front electrode | Rear electrode |
|---|---|
| patterned | patterned |
| patterned | plain |
| plain | patterned |
| plain | plain |

Figure 6:
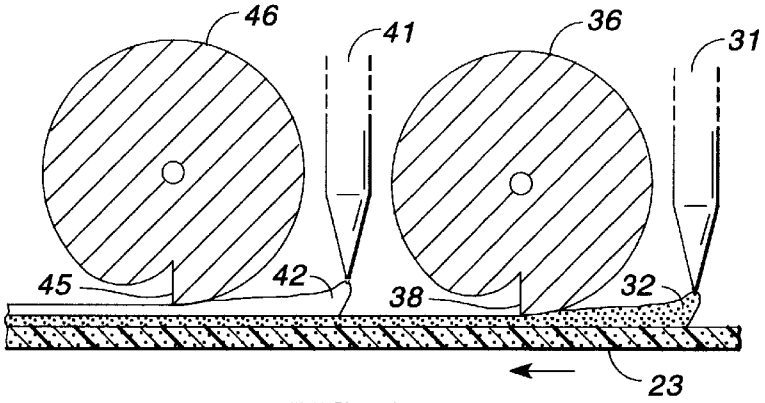
FIG. 6 illustrates sequentially roll coating a dielectric layer and a phosphor layer on a temporary substrate.
Figure 7:
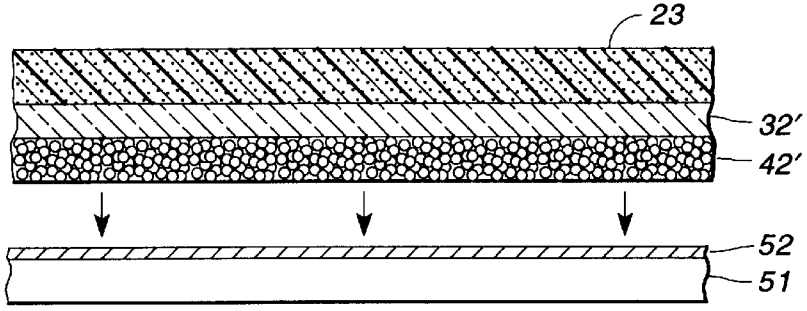
FIG. 7 illustrates laminating the coated layers to a front electrode.

Coated transparent substrates are commercially available from several vendors. The transparent front electrode on such a substrate is patterned, if desired, e.g. by chemical etch or by laser etch, then printed with bus bars as needed, and treated with silane. FIG. 6 illustrates the steps of roll coating dielectric layer 32 and roll coating phosphor layer 42 onto temporary substrate 23. As illustrated in FIG. 7, these two layers are then laminated to front electrode 52. Temporary substrate 23 is then removed and can be re-used.

Figure 8:
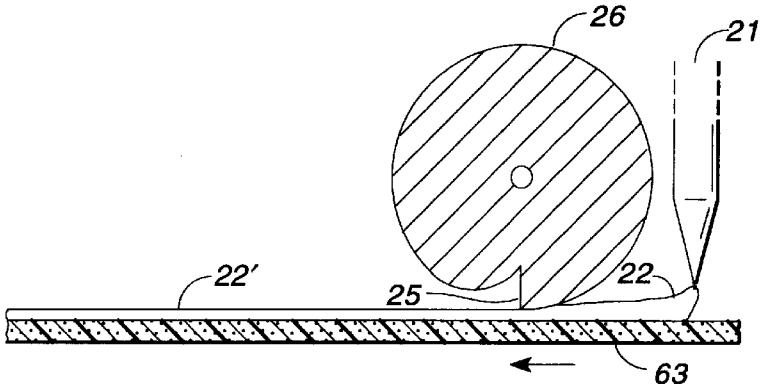
FIG. 8 illustrates roll coating a rear electrode on a temporary substrate.
Figure 9:
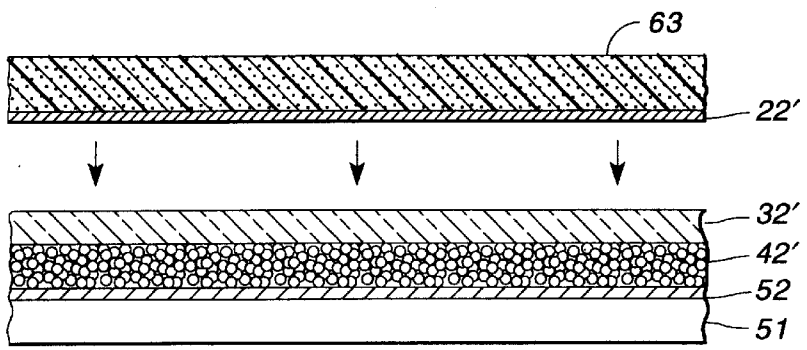
FIG. 9 illustrates laminating the rear electrode to a dielectric layer.

FIG. 8 illustrates the step of roll coating rear electrode 22 on temporary substrate 63. After drying, there are several possible alternatives for the next step in the process. Substrate 63 and rear electrode 22' can be slit, cut, or punched into a plurality of smaller shapes; or the rear electrode can be laminated to the dielectric layer of a panel. As illustrated in FIG. 9, the rear electrode is laminated to dielectric layer 32'. If the rear electrode were cut or patterned, the pieces are held in a suitable jig for lamination with the dielectric layer. For example, slitting temporary substrate 63 and slightly separating one portion of the rear electrode from another portion enables on to make a very narrow gap between the portions.

Figure 10:
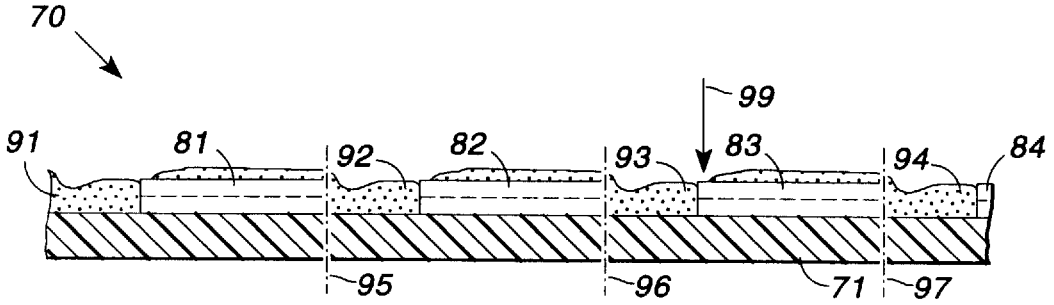
FIG. 10 (PRIOR ART)
FIG. 10 illustrates a prior art process for making a plurality of EL lamps at relatively low cost.

FIG. 10 illustrates making a plurality of EL lamps by screen printing successive layers and slitting the substrate into stripes of lamps. Transparent substrate 71 is coated on the top surface thereof with a thin, transparent, conductive coating (not shown) of ITO. Luminescent EL layers 81, 82, 83 and 84 are screen printed in long stripes running into the plane of the drawing. Conductive stripes 91, 92, 93, and 94 are then screen printed, with each stripe overlying a luminescent EL layer and the gap on either side of the luminescent EL layer. As illustrated in FIG. 10, the gap to the right of each luminescent EL layer is covered.

Panel 70 is then slit along cut lines 95, 96, and 97 to make a plurality of smaller, elongated panels. The cut lines intersect the right-hand edge of each phosphor/dielectric layer, thereby separating the conductive stripe on top of the layer from the conductive stripe in the gap. The portion of the conductive stripe on a luminescent EL layer is the rear electrode and the portion of the conductive stripe in the gap is a bus bar electrically connected to the front electrode. A plurality of lamps are cut or punched from each smaller, elongated panel.

A problem with this technique is that the small gap, indicated at 99, between the conductive stripes exposes a portion of the dielectric layer to separate the front electrode from the rear electrode. This gap is difficult to control precisely must be wider than desired to avoid short circuits. Another problem is that the process is wasteful of lamp material because some of the lamp material is used to isolate the front and rear electrodes and remains unlit.

Figure 11:
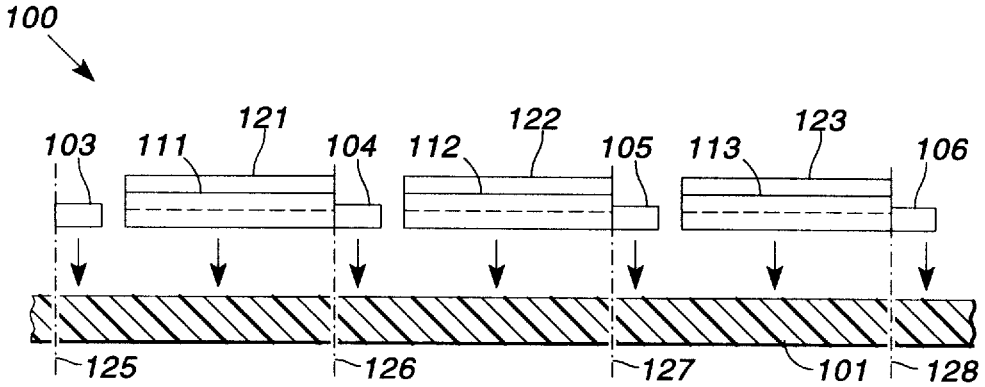
FIG. 11 illustrates a process for making a plurality of EL lamps at even lower cost than the lamps illustrated in FIG. 10.

FIG. 11 is an example of making lamps using roll coated panels in accordance with the invention. Transparent substrate 101 is coated on the top surface thereof with a thin, transparent, conductive coating (not shown) of ITO. Bus bars 103, 104, 105, and 106 are made by roll coating a temporary substrate with conductive ink, drying, cutting the temporary substrate into strips and laminating the strips to substrate 101. The bus bars extend into the plane of the drawing and provide a low resistance contact to the layer of ITO.

Luminescent EL layers 111, 112, and 113 are roll coated on a temporary substrate, followed by rear electrodes 121, 122, and 123, as described in conjunction with FIG. 3. The temporary substrate is cut into strips and the strips are laminated to transparent substrate 101. Preferably, the luminescent EL layers are laminated at the same time as the bus bars and abut a bus bar on one side, as shown. Panel 100 is then slit along cut lines 125, 126, 127, and 128 to make a plurality of smaller, elongated panels. From these panels, a plurality of lamps are cut or punched. Control of spacing is much more precise than with the process illustrated in FIG. 10, permitting gaps of ten mils or less. More significantly, the process can be continuous, which reduces the cost of manufacturing the lamps.

The invention thus provides a low cost process for making EL panels in which the panels can have a large area and are produced essentially continuously. When luminous, the panels exhibit less graininess than panels having one or more screen printed layers. The process for making EL panels uses existing materials efficiently to provide chemically compatible, adjoining layers. EL lamps can be made with fewer defects, such as shorts and scratches, because of fine line geometries and minimal handling of the transparent substrate.

Having thus described the invention, it will be apparent to those of skill in the art that various modifications can be made within the scope of the invention. For example, other solvents can be used instead of DMAC. Any solvent capable of dissolving the resins may be substituted. Other resin can be used as a binder as long as (1) the resin can be reflowed during the lamination process and (2) the resin adequately adheres to the transparent front electrode. Binders that cannot be reflowed and that will not adhere to front electrode can be used if a coating of resin (adhesive) is applied either to the front electrode or to the phosphor layer. This resin reflows during the laminating process and binds the phosphor layer to the front electrode. However, because of low dielectric constant of the resin, the lamp will be significantly dimmer than it would be if the phosphor layer were attached directly to the front electrode. To minimize this loss of brightness, the resin can be filled with conductive particles such as indium oxide or indium tin oxide. The rear electrode can use other conductive particles instead of silver flakes, such as carbon, graphite, or nickel. Other vacuum deposited metals or conductive coatings can be used as transparent front electrode instead of ITO. Sputtered ITO is the preferred front electrode. A metal foil, e.g. aluminum or copper, can be used for the rear electrode. In some applications, the temporary substrate can be left on the panel. Graphics can be added to the transparent substrate before or after lamination, e.g. by overprinting the panel, or by laminating a separate sheet containing the graphics to the outside of the transparent substrate when the dielectric layer and the phosphor layer are laminated. The phosphor and the dielectric material can be applied in two separate coatings or in a single coating. Even when coated separately, the layers merge somewhat when laminated, i.e. the boundary between the layers is indistinct.

What is claimed as the invention is:

1. A method for making EL lamps, said method comprising the steps of:

providing a transparent substrate having a transparent conductive layer on a major surface thereof;

providing a temporary substrate having a major surface;

applying a rear electrode to the major surface of said temporary substrate;

applying a dielectric layer over the rear electrode;

applying a phosphor layer over the dielectric layer; and laminating said phosphor layer to said conductive layer.

2. The process as set forth in claim 1 wherein said laminating step is followed by the step of removing said temporary substrate.

3. The process as set forth in claim 1 wherein said rear electrode is applied by roll coating, said dielectric layer is applied by roll coating, said phosphor layer is applied by roll coating.

4. The process as set forth in claim 3 wherein said laminating step is followed by the step of removing said temporary substrate.

5. The process as set forth in claim 1 wherein the step of applying the rear electrode is followed by the step of at least partially drying the rear electrode, the step of applying said dielectric layer is followed by the step of at least partially drying the dielectric layer, the step of applying said phosphor layer is followed by the step of at least partially drying the phosphor layer.

6. A method for making EL lamps, said method comprising the steps of:

providing a transparent substrate having a transparent conductive layer on a major surface thereof;

providing a temporary substrate having a major surface;

roll coating said temporary substrate with a dielectric layer;

roll coating a phosphor layer over the dielectric layer; and laminating said phosphor layer to said conductive layer.

7. The method as set forth in claim 6 and further including the step of:

patterning said conductive layer prior to laminating said phosphor layer.

8. A method for making EL lamps, said method comprising the steps of:

providing a transparent substrate having a transparent conductive layer on a major surface thereof;

providing a temporary substrate having a major surface;

applying a luminescent EL layer to said temporary substrate; and laminating said luminescent EL layer to said conductive layer.

9. The method as set forth in claim 8 and further including the step of:

applying a rear electrode to the major surface of said temporary substrate prior to applying the luminescent EL layer.

10. The method as set forth in claim 8 wherein said applying step includes roll coating the luminescent EL layer.

* * * * *